US008573586B2

(12) United States Patent
Kobayashi et al.

(10) Patent No.: US 8,573,586 B2
(45) Date of Patent: Nov. 5, 2013

(54) SHEET FEEDER AND IMAGE FORMING APPARATUS

(75) Inventors: Shun Kobayashi, Kanagawa (JP); Yoshikuni Ishikawa, Tokyo (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/409,204

(22) Filed: Mar. 1, 2012

(65) Prior Publication Data

US 2012/0228817 A1 Sep. 13, 2012

(30) Foreign Application Priority Data

Mar. 10, 2011 (JP) ..... 2011-053099

(51) Int. Cl.
*B65H 3/16* (2006.01)
*B65H 1/08* (2006.01)
*B65H 3/04* (2006.01)

(52) U.S. Cl.
USPC ..... 271/18.2; 271/18.1; 271/147; 271/34

(58) Field of Classification Search
USPC ..... 271/18.1, 33, 34, 193, 275, 147
See application file for complete search history.

(56) References Cited

U.S. PATENT DOCUMENTS 8,267,394 B2 * 9/2012 Higaki et al. ..... 271/18.2
2011/0204557 A1 * 8/2011 Ishikawa et al. ..... 271/18.1
2011/0204558 A1 * 8/2011 Takahashi et al. ..... 271/18.1
2011/0227275 A1 * 9/2011 Poh et al. ..... 271/18.1
2012/0061904 A1 * 3/2012 Higaki et al. ..... 271/34
2012/0235346 A1 * 9/2012 Ikeda et al. ..... 271/18.1
2012/0306146 A1 * 12/2012 Higaki et al. ..... 271/34

FOREIGN PATENT DOCUMENTS

JP 2003-237958 A 8/2003
JP 2003237962 A 8/2003
JP 2010037047 A 2/2010
JP 2010126317 A 6/2010
WO WO 2010061895 A1 * 6/2010

* cited by examiner

*Primary Examiner* — Patrick Cicchino
(74) *Attorney, Agent, or Firm* — Harness, Dickey & Pierce P.L.C.

(57) ABSTRACT

A sheet feeder includes: an attraction separation unit including an attraction belt stretched between rollers and facing the upper surface of a sheet bundle to attract an uppermost sheet thereof, rotatably supported by a support member at a position upstream of the attraction belt in a sheet feeding direction, and supporting the rollers to be released from the support upon contact of the rollers with the uppermost sheet via the attraction belt; and a swing device for swinging the attraction separation unit around the support member as a pivot to move the attraction belt between an attraction position and a feed position more distant from the sheet bundle than the attraction position, and swinging, after the uppermost sheet has been attracted to the attraction belt at the attraction position, the attraction belt to the feed position to be rotated to feed the uppermost sheet.

19 Claims, 7 Drawing Sheets

SHEET FEEDER AND IMAGE FORMING APPARATUS

CROSS-REFERENCE TO RELATED APPLICATION

This patent application is based on and claims priority pursuant to 35 U.S.C. §119 to Japanese Patent Application No. 2011-053099, filed on Mar. 10, 2011, in the Japanese Patent Office, the entire disclosure of which is hereby incorporated by reference herein.

FIELD OF THE INVENTION

The present invention relates to a sheet feeder and an image forming apparatus.

BACKGROUND OF THE INVENTION

As a method of separating and feeding stacked sheets, such as documents and recording sheets, there is an electrostatic attraction separation method of generating an electric field on an attraction belt and bringing the attraction belt into contact with a sheet to attract and separate the sheet from other sheets. A background sheet feeder according to the electrostatic attraction separation method includes an attraction separation unit which includes an attraction belt formed by a dielectric member wound around two rollers, a charger for supplying alternating charge to the attraction belt, and a holder holding the attraction belt and the charger. The holder rotatably supports the two rollers, and is fixed to a rotary shaft provided upstream of the two rollers in the sheet feeding direction. One end of the rotary shaft is provided with a gear mechanism including a rack and pinion and a swing mechanism serving as a swing device for swinging the attraction separation unit. Further, one of the two rollers disposed on the upstream side in the sheet feeding direction (hereinafter referred to as upstream tension roller) includes a shaft inserted in slots in the holder and supported by the holder to be movable in a direction perpendicular to the sheet surface of a sheet bundle.

Prior to the sheet feeding operation, the attraction belt held by the holder via the two rollers is located at a position separated from the sheet bundle. In this state, the upstream tension roller is in contact with the respective lower ends of the slots, and is closer to the sheet bundle than the other roller disposed on the downstream side in the sheet feeding direction (hereinafter referred to as downstream tension roller) is.

To feed the uppermost sheet of the sheet bundle by separating the sheet from the other sheets, the attraction belt is first rotated and supplied with alternating charge. After the supply of the alternating charge to the attraction belt, the rotation of the attraction belt is stopped. Then, the swing mechanism is driven to swing the attraction separation unit toward the sheet bundle. According to this action, the upstream tension roller first comes into contact with the uppermost sheet of the sheet bundle via the attraction belt. If the attraction separation unit in this state is further swung, the shaft of the upstream tension roller moves within the slots in the holder and comes into contact with the respective upper ends of the slots. At the same time, the downstream tension roller comes into contact with the uppermost sheet of the sheet bundle via the attraction belt. According to this action, an area of the attraction belt facing the sheet bundle is brought into contact with the uppermost sheet, and the uppermost sheet of the sheet bundle is attracted to the attraction belt. After the attraction of the uppermost sheet of the sheet bundle to the attraction belt, the swing mechanism is driven to swing the attraction separation unit in a direction separating from the sheet bundle. According to this action, the downstream tension roller is separated from the sheet bundle together with the holder. By contrast, the upstream tension roller remains on the sheet bundle, and the shaft of the upstream tension roller relatively moves within the slots. If the attraction separation unit is further swung in the direction separating from the sheet bundle, the shaft of the upstream tension roller comes into contact with the lower ends of the slots, and the upstream tension roller is separated from the sheet bundle while being supported by the lower ends of the slots. According to this action, the uppermost sheet attracted to the attraction belt is lifted by the attraction belt and separated from a second sheet. Then, the attraction belt is driven to rotate and feed the uppermost sheet attracted thereto.

To reliably bring the uppermost sheet of the sheet bundle and the attraction belt into contact with each other, the background sheet feeder includes a contact state detection device which detects the contact of the attraction belt with the sheet bundle. Specifically, the contact state detection device is provided to the upper ends of the slots. As described above, when the area of the attraction belt facing the sheet bundle comes into contact with the uppermost sheet of the sheet bundle, the shaft of the upstream tension roller comes into contact with the upper ends of the slots. Thus, the contact state detection device is provided at the upper ends of the slots. On the basis of the contact of the shaft of the upstream tension roller with the contact state detection device, therefore, the contact of the area of the attraction belt facing the sheet bundle with the uppermost sheet is detected. Then, upon detection by the contact state detection device of the contact of the attraction belt with the uppermost sheet, the swing of the attraction separation unit is stopped. With this configuration, the attraction belt is expected to be reliably brought into contact with the uppermost sheet.

In the background sheet feeder, however, the provision of the contact state detection device results in an increase in the number of components and the cost of the sheet feeder. Further, the driving of the swing device is controlled on the basis of the result of detection by the contact state detection device, and thus the drive control is complicated. Further, a bottom plate loaded with the sheet bundle is configured to be movable in a direction perpendicular to the sheet surface of the sheet bundle. When the bottom plate is lifted to move the uppermost sheet to a predetermined position, if the movement amount of a downstream end portion of the bottom plate in the sheet feeding direction moved by a drive device is less than the movement amount of an upstream end portion of the bottom plate in the sheet feeding direction, the sheet bundle loaded on the bottom plate may be inclined. Such an inclination may cause the downstream side of the sheet bundle in the sheet feeding direction to be more distant from the attraction belt than the upstream side of the sheet bundle in the sheet feeding direction is. In this case, even if the shaft of the upstream tension roller comes into contact with the contact state detection device and the contact state detection device detects the contact, the downstream side of the attraction belt in the sheet feeding direction may be separated from the uppermost sheet, and the area of the attraction belt facing the sheet bundle may fail to come into contact with the uppermost sheet of the sheet bundle.

SUMMARY OF THE INVENTION

The present invention describes a novel sheet feeder. In one example, a novel sheet feeder includes an attraction separation unit and a swing device. The attraction separation unit includes an attraction belt stretched between rollers and disposed to face the upper surface of a stacked sheet bundle to attract an uppermost sheet of the sheet bundle, rotatably supported by a support member at a position upstream of the attraction belt in a sheet feeding direction, and configured to support the rollers to be released from the support member when the rollers contact the uppermost sheet of the sheet bundle via the attraction belt. The swing device swings the attraction separation unit around the support member as a pivot to move the attraction belt back and forth between an attraction position for attracting the uppermost sheet of the sheet bundle to the attraction belt and a feed position for feeding the uppermost sheet attracted to the attraction belt that is more distant from the sheet bundle than is the attraction position, and configured to swing the attraction belt to the feed position to be rotated to feed the uppermost sheet after the uppermost sheet has been attracted to the attraction belt at the attraction position.

The rollers may be movable in a direction perpendicular to the upper surface of the sheet bundle.

The swing device may swing the attraction separation unit toward the sheet bundle until both of the rollers move in a direction perpendicular to the attraction separation unit.

The attraction separation unit may be configured to, when moved in a direction separating from the sheet bundle, allow the downstream one of the rollers in the sheet feeding direction to separate from the sheet bundle before the upstream one of the rollers in the sheet feeding direction separates from the sheet bundle.

The swing device may include a gear mechanism.

The gear mechanism may include a first gear portion provided to a downstream end portion of the attraction separation unit in the sheet feeding direction and a second gear portion meshing with the first gear portion.

The downstream one of the rollers in the sheet feeding direction may be movable relative to the attraction separation unit along a substantially circular arc locus centered on the pivot of swing of the attraction separation unit.

The above-described sheet feeder may further include a biasing device to bias the downstream one of the rollers in the sheet feeding direction toward the sheet bundle.

The attraction belt may be located at the attraction position the biasing device biases the downstream one of the rollers in the sheet feeding direction in a direction perpendicular to the upper surface of the sheet bundle.

The biasing device may bias the downstream one of the rollers in the sheet feeding direction toward the sheet bundle and downstream in the sheet feeding direction.

The present invention further describes a novel image forming apparatus. In one example, a novel image forming apparatus includes an image forming device configured to form an image on a sheet and the above-described sheet feeder configured to separate an uppermost sheet from a stacked sheet bundle and feed the uppermost sheet to the image forming device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
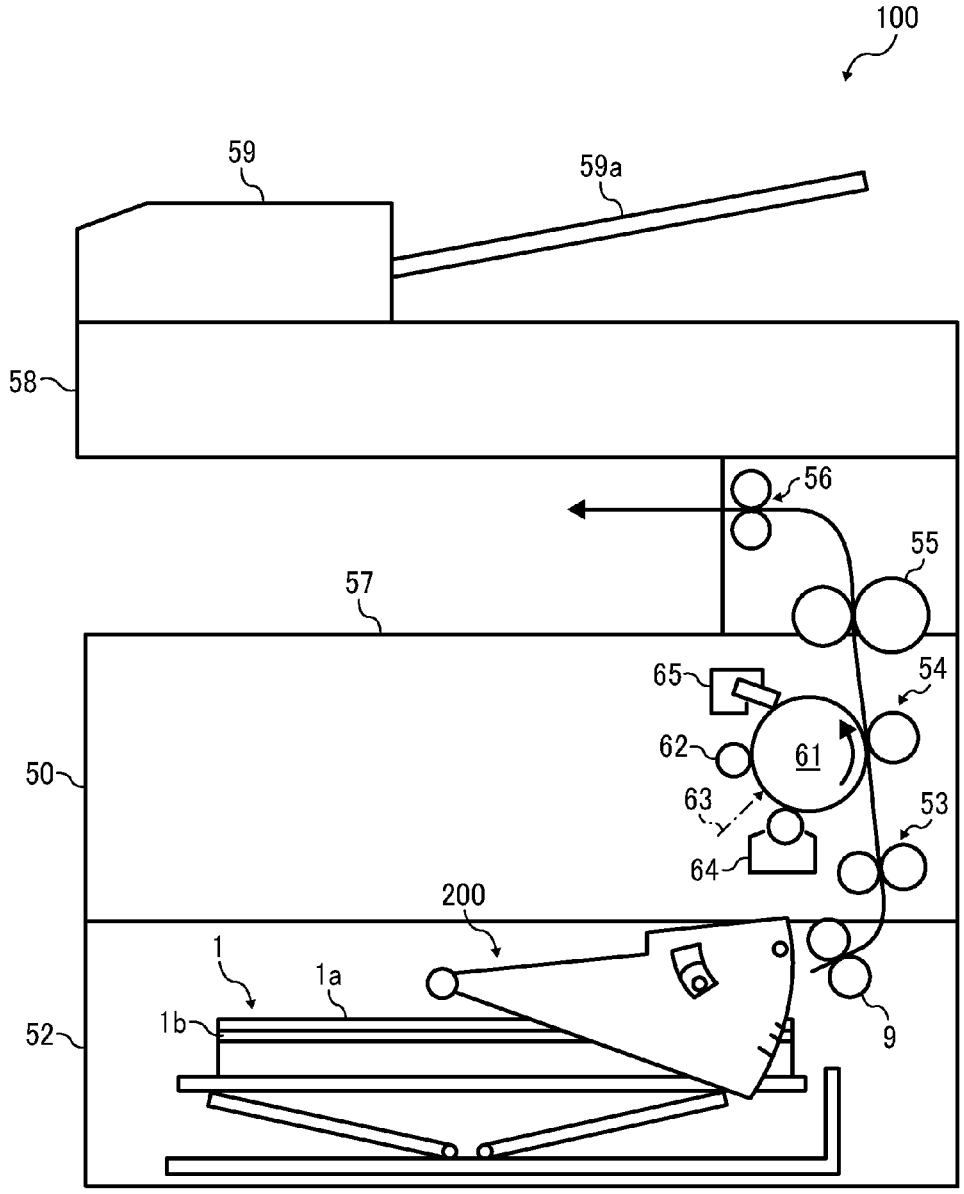
FIG. 1 is a schematic diagram illustrating a copier according to an embodiment.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, a description will be made of an embodiment of the present invention applied to a copier as an electrophotographic image forming apparatus. Needless to say, the present invention is not limited to the image forming apparatus of the present embodiment, and is also applicable to, for example, an image forming apparatus according to the inkjet method.

FIG. 1 is a schematic diagram illustrating a copier 100 according to the present embodiment. The copier 100 includes an automatic document feeder 59, a document reading unit 58, and an image forming unit 50. The automatic document feeder 59 separates a document from a document bundle loaded on a document tray 59*a*, and automatically feeds the document onto a contact glass on the document reading unit 58. The document reading unit 58 reads the document fed onto the contact glass by the automatic document feeder 59. The image forming unit 50 serves as an image forming device which forms an image on a recording medium sheet (hereinafter referred to as sheet) fed from a sheet feeding unit 52 on the basis of the document image read by the document reading unit 58. The sheet feeding unit 52 stores a sheet bundle 1 including a plurality of stacked sheets, and feeds from the sheet bundle 1 an uppermost sheet 1*a* at the uppermost position thereof to the image forming unit 50. In the present embodiment, the image forming unit 50 and the sheet feeding unit 52 are separable from each other.

The image forming unit 50 includes a photoconductor 61 serving as a latent image carrying member and surrounded by a charging device 62, a development device 64, a transfer device 54, a photoconductor cleaning device 65, and so forth. The image forming unit 50 further includes a not-illustrated optical writing unit for applying laser light 63 to the photoconductor 61 and a fixing device 55 for fixing a toner image on a sheet.

In the above-configured image forming unit 50, the outer circumferential surface of the photoconductor 61 is first uniformly charged by the charging device 62 in accordance with the rotation of the photoconductor 61. Then, the photoconductor 61 is applied with the laser light 63 by the not-illustrated optical writing unit on the basis of image data input from, for example, a personal computer or a word processor or image data of the document read by the document reading unit 58. According to this action, an electrostatic latent image is formed on the photoconductor 61. Thereafter, toner supplied by the development device 64 adheres to and visualizes the electrostatic latent image. According to this action, a toner image is formed on the photoconductor 61. By contrast, the sheet feeding unit 52 feeds each sheet by separating the sheet from the other sheets, and causes the sheet to come into contact with registration rollers 53 to be stopped. The sheet brought into contact with and stopped by the registration rollers 53 is then fed to a transfer unit, in which the photoconductor 61 and the transfer device 54 face each other, in proper timing with the formation of the toner image in the image forming unit 50. In the transfer unit, the toner image on the photoconductor 61 is transferred onto the supplied sheet. The sheet having the toner image transferred thereto is subjected to a toner image fixing process by the fixing device 55, and then is discharged to a sheet discharge tray 57 by a sheet discharging roller pair 56. By contrast, the surface of the photoconductor 61 after the transfer of the toner image is cleaned by the photoconductor cleaning device 65 to remove residual toner from the surface and prepare the photoconductor 61 for the next image forming operation. FIG. 1 also illustrates a feed roller pair 9, a sheet feeder 200, and a second sheet 1*b* of the sheet bundle 1, which will be described later.

Figure 2:
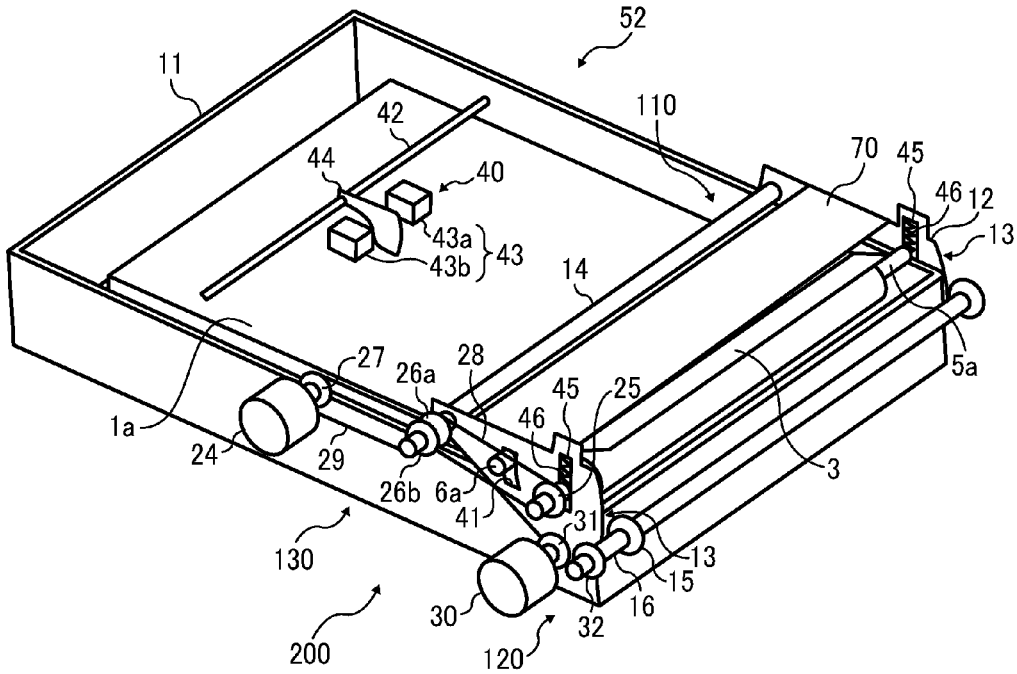
FIG. 2 is a perspective view illustrating a schematic configuration of a sheet feeding unit of the copier.
Figure 3:
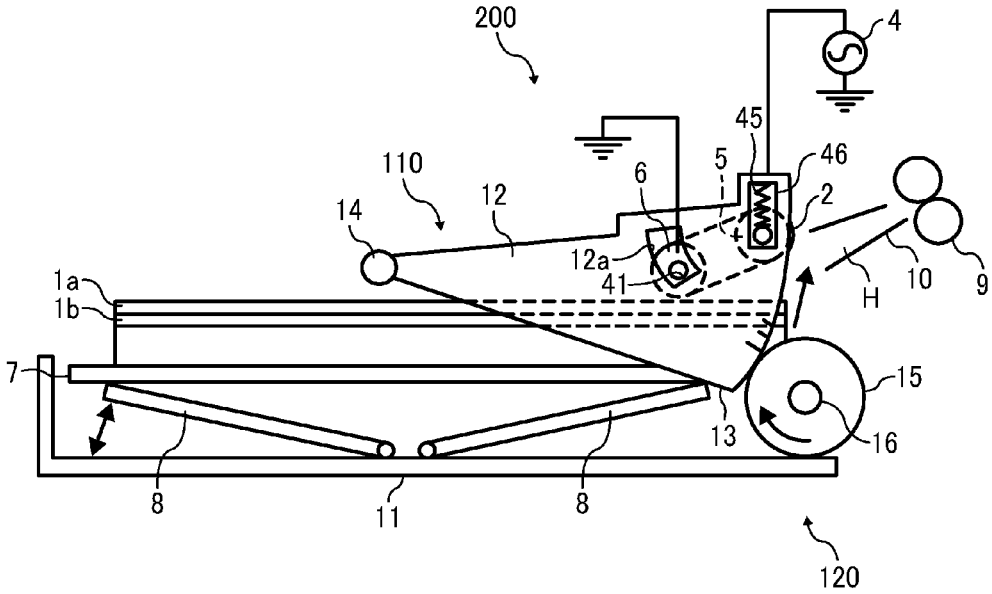
FIG. 3 is a schematic diagram illustrating a basic configuration of a sheet feeder provided in the sheet feeding unit.
Figure 4A:
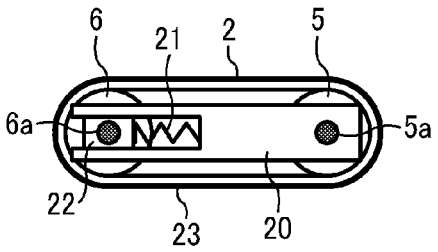
FIGS. 4A and 4B are diagrams illustrating a configuration of main components of an attraction separation unit of the sheet feeder.
Figure 4B:
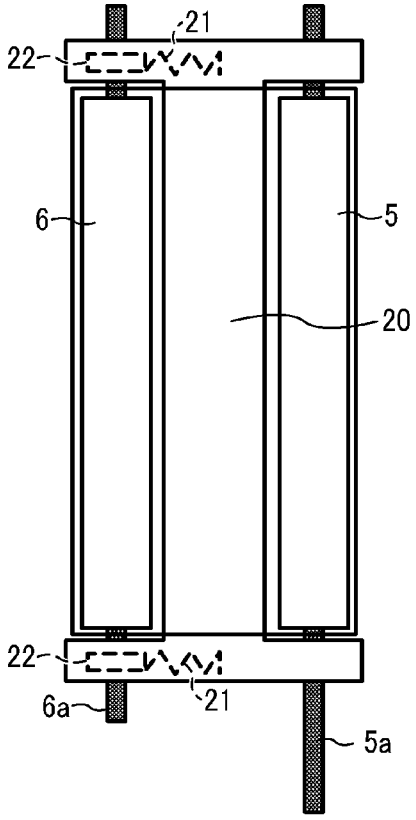

FIG. 2 is a perspective view illustrating a schematic configuration of the sheet feeding unit 52. FIG. 3 is a schematic diagram illustrating the sheet feeder 200. FIGS. 4A and 4B are diagrams illustrating a configuration of main components of an attraction separation unit 110 of the sheet feeder 200. The sheet feeding unit 52 includes a sheet feeding cassette 11 and the sheet feeder 200. The sheet feeding cassette 11 serves as a sheet material storing unit for storing a plurality of stacked sheets. The sheet feeder 200 separates and feeds, from the sheet bundle 1 including a plurality of sheets placed on the sheet feeding cassette 11, the uppermost sheet 1*a* at the uppermost position of the sheet bundle 1.

As illustrated in FIG. 3, the sheet feeding cassette 11 includes a bottom plate 7 for carrying the sheet bundle 1 of a plurality of stacked sheets loaded thereon. Support members 8 for supporting the bottom plate 7 are rotatably attached between the bottom plate 7 and a bottom portion of the sheet feeding cassette 11. Further, as illustrated in FIG. 2, the sheet feeding unit 52 is provided with a sheet detection device 40 which detects the arrival of the uppermost sheet 1*a* of the sheet bundle 1 to a predetermined position. The sheet detection device 40 includes a transmissive optical sensor 43 including a light receiving portion 43*a* and a light emitting portion 43*b* and a feeler 44 rotatably supported by a shaft 42 provided to the body of the sheet feeder 200. If the support members 8 are rotated by a not illustrated drive motor to lift the bottom plate 7, the sheet bundle 1 loaded on the bottom plate 7 is lifted, and the uppermost sheet 1*a* comes into contact with the feeler 44. In this state, the light receiving portion 43*a* receives the light emitted from the light emitting portion 43*b* in the transmissive optical sensor 43. If the bottom plate 7 is further lifted, the feeler 44 blocks the light from the light emitting portion 43*b*, and prevents the light receiving portion 43*a* from receiving the light. According to this action, the arrival of the uppermost sheet 1*a* of the sheet bundle 1 to the predetermined position is detected, and the rotation of the support members 8 is stopped.

The sheet feeder 200 includes an attraction separation unit 110, a swing mechanism 120 serving as a swing device which swings the attraction separation unit 110, and a drive mechanism 130 that rotates an attraction belt 2 of the attraction separation unit 110. As illustrated in FIGS. 4A and 4B, the attraction separation unit 110 includes the attraction belt 2 stretched between a downstream tension roller 5 and an upstream tension roller 6. The attraction belt 2 has a two-layer structure including an outer layer and a conductive layer. The outer layer is made of polyethylene terephthalate having a resistance of approximately $10^8$ Ω·cm (ohm centimeters) or more and a thickness of approximately 50 μm. The conductive layer has a resistance of approximately $10^6$ Ω·cm or less, and is formed by aluminum vapor deposition. The above-described two-layer structure of the attraction belt 2 allows the conductive layer to be used as a grounded opposite electrode. Thus, an electrode member 3 connected to a charging power supply 4 in FIG. 3 and serving as a charging device which supplies charge to the attraction belt 2 is allowed to be provided at any position in contact with the outer layer of the attraction belt 2. Further, the inner surfaces of the opposite end edges of the attraction belt 2 are provided with ribs 23 for preventing meandering of the attraction belt 2. The ribs 23 engage with the opposite end surfaces of the downstream and upstream tension rollers 5 and 6 to prevent the attraction belt 2 from meandering.

The downstream tension roller 5 has an outer circumferential surface provided with a conductive rubber layer having a resistance value of approximately $10^6$ Ω·cm. The upstream tension roller 6 is a metal roller. The downstream tension roller 5 and the upstream tension roller 6 are both grounded. The downstream tension roller 5 has a relatively small diameter suitable for separating a sheet from the attraction belt 2 in accordance with the curvature thereof. That is, the diameter of the downstream tension roller 5 is set to a relatively small value to increase the curvature. According to this action, the sheet attracted to and fed by the attraction belt 2 separates from the downstream tension roller 5 and enters a feed path H (see FIG. 3) formed by guide members 10 disposed on the downstream side in the sheet feeding direction.

Further, as illustrated in FIGS. 4A and 4B, a shaft 5*a* of the downstream tension roller 5 is rotatably supported by a housing 20. A shaft 6*a* of the upstream tension roller 6 is rotatably supported by shaft bearings 22 held to be slidable in the sheet feeding direction relative to the housing 20. The shaft bearings 22 are biased by respective springs 21 toward the upstream side in the sheet feeding direction. According to this action, the upstream tension roller 6 is biased toward the upstream side in the sheet feeding direction, and applies tension to the attraction belt 2.

As illustrated in FIGS. 2 and 3, the opposite ends of the attraction separation unit 110 in the width direction of the attraction belt 2 (hereinafter referred to as belt width direction) are respectively provided with brackets 12 for swingably holding the attraction belt 2. The brackets 12 are rotatably supported by a support shaft 14 provided upstream of the upstream tension roller 6 in the sheet feeding direction. With this configuration, the attraction separation unit 110 is swung by the later-described swing mechanism 120 around the support shaft 14 as a pivot between an attraction position for attracting the uppermost sheet 1*a* of the sheet bundle 1 to the attraction belt 2 and a feed position for feeding the uppermost sheet 1*a* attracted to the attraction belt 2.

The upstream tension roller 6 and the downstream tension roller 5 are held by the brackets 12 to be movable in a direction perpendicular to the upper surface of the sheet bundle 1. Specifically, each of the brackets 12 includes two slots, i.e., an upstream slot 12*a* and a downstream slot 45. The shaft 6*a* of the upstream tension roller 6 passes through the upstream slots 12*a*, and the shaft 5*a* of the downstream tension roller 5 passes through the downstream slots 45. Further, the downstream tension roller 5 is biased toward the sheet bundle 1 by springs 46. As illustrated in FIG. 3, when the attraction separation unit 110 is located at the feed position, the shaft 6*a* of the upstream tension roller 6 is in contact with respective lower ends 41 of the upstream slots 12*a*, and the shaft 5*a* of the downstream tension roller 5 is in contact with respective lower ends of the downstream slots 45.

The lower ends 41 of the upstream slots 12*a*, with which the shaft 6*a* of the upstream tension roller 6 comes into contact, is positioned closer to the sheet bundle 1 than the lower ends of the downstream slots 45, with which the shaft 5*a* of the downstream tension roller 5 comes into contact. Further, each of the upstream slots 12*a* provided in the brackets 12 is formed into an arc centered on the center of rotation of the downstream tension roller 5 in contact with the lower ends of the downstream slots 45, such that the distance between the center of rotation of the upstream tension roller 6 and the center of rotation of the downstream tension roller 5 is unchanged by the movement of the shaft 6*a* of the upstream tension roller 6 within the upstream slots 12*a*. Consequently, the tension of the attraction belt 2 is unchanged during the swing of the attraction separation unit 110 between the attraction position and the feed position. Even if the tension of the attraction belt 2 is approximately 5 N (newtons) or less, it is normally possible to feed a sheet attracted to the attraction belt 2 by driving the attraction belt 2 to rotate, without causing a slip between the upstream and downstream tension rollers 6 and 5 and the attraction belt 2. In sheet feeding under special conditions, such as the feeding of a sheet having relatively high adhesive force, however, a slip may occur between the attraction belt 2 and the upstream and downstream tension rollers 6 and 5. It is therefore desirable to increase the coefficient of friction of the respective surfaces of the upstream and downstream tension rollers 6 and 5 to minimize the occurrence of the slip.

Figure 5:
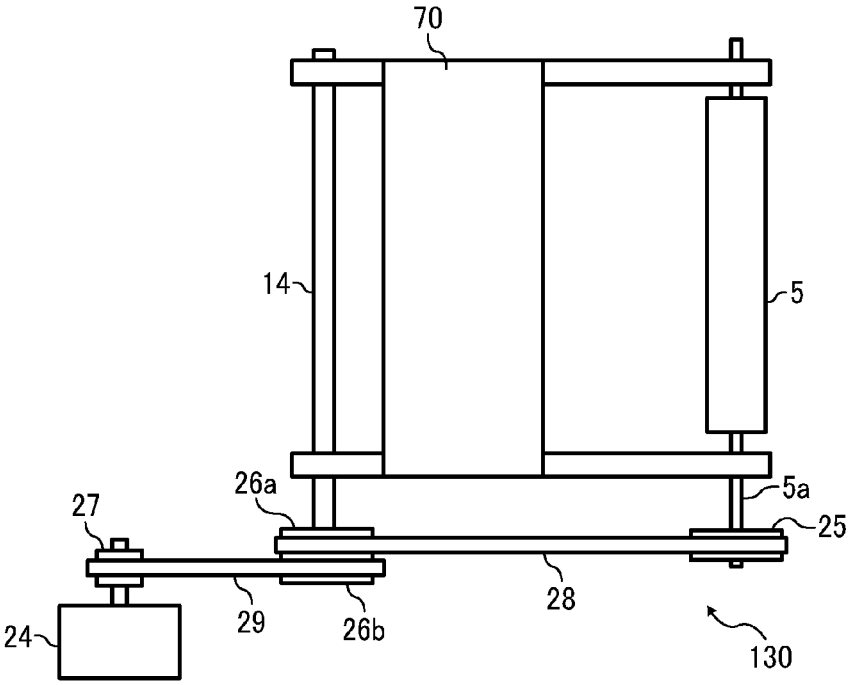
FIG. 5 is a schematic configuration diagram of a drive mechanism of the sheet feeder.

FIG. 5 is a schematic configuration diagram of the drive mechanism 130 which drives the attraction belt 2 to rotate. The support shaft 14 rotatably supporting the brackets 12 has one end fixed with a first driven pulley 26*a* and a second drive pulley 26*b*. The downstream tension roller 5 has one end fixed with a second driven pulley 25. A driven timing belt 28 is wound around the first driven pulley 26*a* and the second driven pulley 25. Further, a drive motor 24 is provided upstream of the support shaft 14 in the sheet feeding direction. The drive motor 24 has a motor shaft fixed with a first drive pulley 27. A drive timing belt 29 is wound around the first drive pulley 27 and the second drive pulley 26*b*.

When the drive motor 24 is driven, the downstream tension roller 5 is driven to rotate via the drive timing belt 29 and the driven timing belt 28. According to this action, the attraction belt 2 is driven to rotate, and the upstream tension roller 6 is rotated in accordance with the rotation of the attraction belt 2 owing to the friction of the inner circumferential surface of the attraction belt 2. Further, in the present embodiment, the drive force of the drive motor 24 is transmitted to the downstream tension roller 5 via the support shaft 14 supporting the brackets 12. With this configuration, the attraction separation unit 110 swings around the support shaft 14 as a pivot, as described later. Thus, the distance between the downstream tension roller 5 and the support shaft 14 is unchanged by the swing of the attraction separation unit 110. Accordingly, the tension of the driven timing belt 28 is maintained, and the drive force is favorably transmitted to the downstream tension roller 5.

Further, as illustrated in FIGS. 2 and 3, the swing mechanism 120 serving as the swing device which swings the brackets 12 is provided on the downstream side in the sheet feeding direction. The swing mechanism 120 includes rack gear portions 13 and pinion gears 15. Each of the rack gear portions 13 formed in a downstream end portion of the corresponding bracket 12 in the sheet feeding direction serves as a first drive transmitting portion. Each of the pinion gears 15 fixed to a rotary shaft 16 serves as a second drive transmitting portion meshing with the corresponding rack gear portion 13. The swing mechanism 120 further includes a swing motor 30. The rotary shaft 16 has one end provided with a driven gear 32 meshing with a motor gear fixed to a motor shaft of the swing motor 30. With the swing motor 30 rotating the rotary shaft 16 fixed with the pinion gears 15, the pinion gears 15 are rotated. According to this action, the pinion gears 15 provided to the opposite ends of the attraction separation unit 110 in the belt width direction are driven to rotate by the single swing motor 30. Consequently, the number of components is reduced, and thus the cost of the sheet feeder 200 is reduced. Further, the respective rack and pinions provided to the opposite ends of the attraction separation unit 110 in the belt width direction are driven in synchronization by a relatively simple configuration.

The rack gear portions 13 have an arc centered on the support shaft 14. During the swing of the attraction separation unit 110, the rack gear portions 13 formed in the brackets 12 swing around the support shaft 14. With the rack gear portions 13 formed into an arc centered on the support shaft 14, therefore, the meshing between the rack gear portions 13 and the pinion gears 15 is maintained during the swing of the attraction separation unit 110. Further, with the rack gear portions 13 formed in the downstream end portions of the brackets 12 in the sheet feeding direction, the number of components is reduced and the configuration is simplified, as compared with a case where rack gears formed separately from the brackets 12 are attached to the brackets 12. Further, in the rack and pinions of the swing mechanism 120, the pinions (i.e., pinion gears 15) are provided to the body of the sheet feeder 200. Therefore, the configuration for transmitting the drive to the pinions is simplified, as compared with a case where the pinions are provided to the attraction separation unit 110.

When the swing motor 30 is driven, the pinion gears 15 are rotated, and the rack gear portions 13 move in a direction approaching or separating from the sheet bundle 1. According to this action, the brackets 12 swing around the support shaft 14 as a pivot.

The brackets 12 are connected and fixed by a reinforcing member 70. With the brackets 12 connected and fixed by the reinforcing member 70, the two brackets 12 are integrally swung. This configuration therefore minimizes twisting of the attraction belt 2 held by the brackets 12 during the swing of the brackets 12, and minimizes separation from the attraction belt 2 of the uppermost sheet 1*a* attracted thereto.

Figure 6:
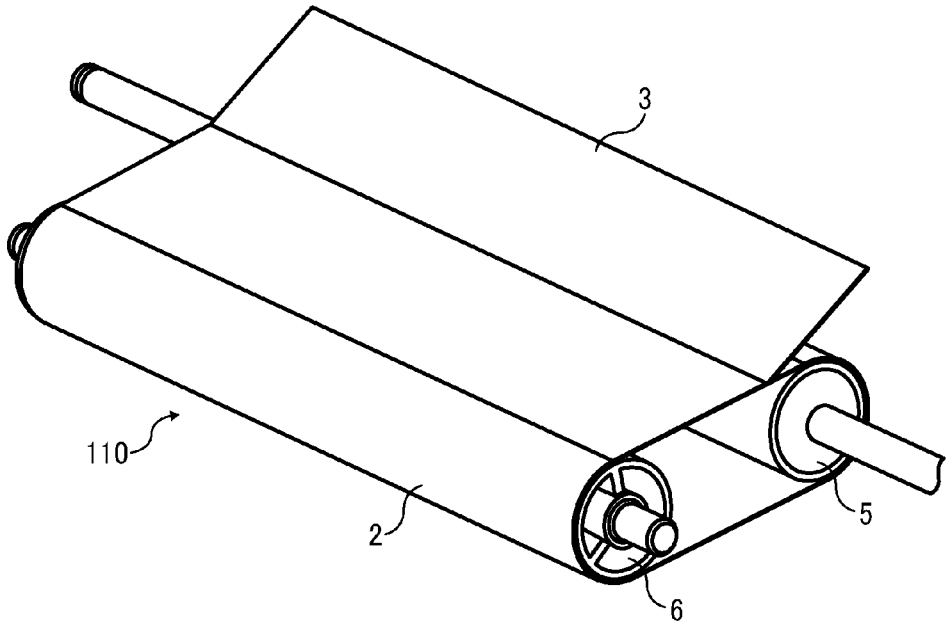
FIG. 6 is a perspective view illustrating a configuration of main components of the attraction separation unit.
Figure 7:
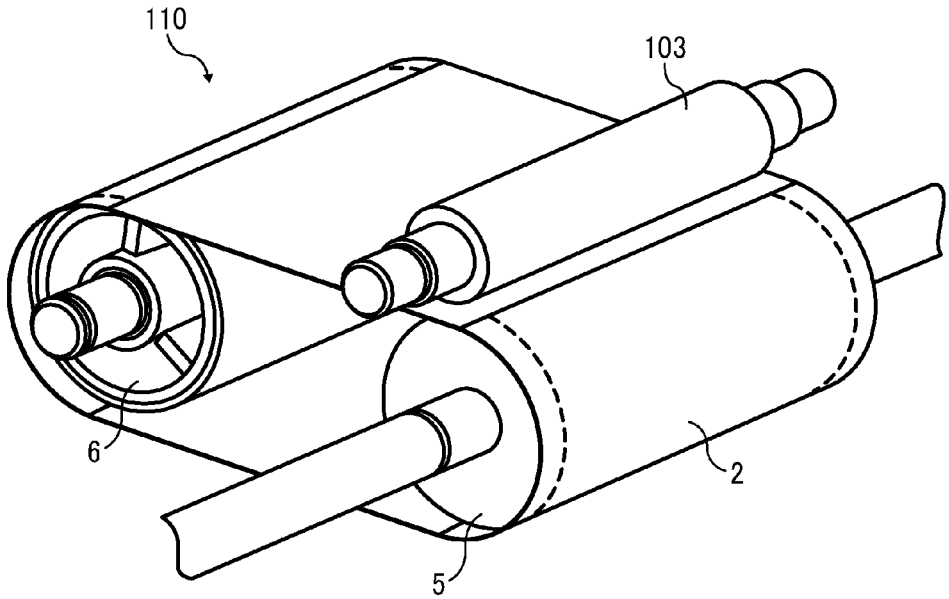
FIG. 7 is a perspective view illustrating a modified example of the attraction separation unit.

As illustrated in FIG. 6, the blade-like electrode member 3 serving as a charging device which charges the outer circumferential surface of the attraction belt 2 is in contact with the surface of the attraction belt 2. The electrode member 3 is connected to the charging power supply 4 which generates an alternating-current (hereinafter referred to as AC) voltage. With the electrode member 3 formed into a blade shape, it is relatively easy to reduce the pitch of alternating charging intervals, and stable charging is performed even if the attraction belt 2 has minute undulations. Although the present embodiment uses the blade-like electrode member 3 as the charging device, a roller-like electrode member 103 as illustrated in FIG. 7 may also be used as the charging device.

A sheet feeding operation using the sheet feeder 200 of the present embodiment will now be described with reference to FIGS. 8A to 8E.

Figure 8A:
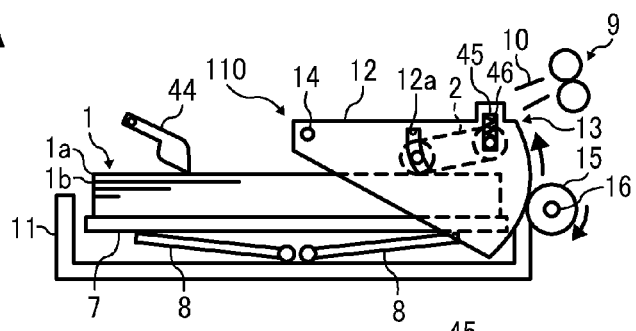
FIGS. 8A to 8E are diagrams for explaining separation and feeding of a sheet by the sheet feeder.

Normally, the bottom plate 7 is located at a lowered position, and the attraction separation unit 110 is located at the attraction position, as illustrated in FIG. 8A. Upon receipt of a sheet feeding signal, the swing motor 30 is first driven to drive the pinion gears 15 to rotate in the clockwise direction in the drawing. According to this action, the attraction separation unit 110 is swung around the support shaft 14 as a pivot in the counterclockwise direction in the drawing, i.e., the direction separating from the sheet bundle 1. Then, when the attraction separation unit 110 is swung to the feed position, the driving of the swing motor 30 is stopped.

Figure 8B:
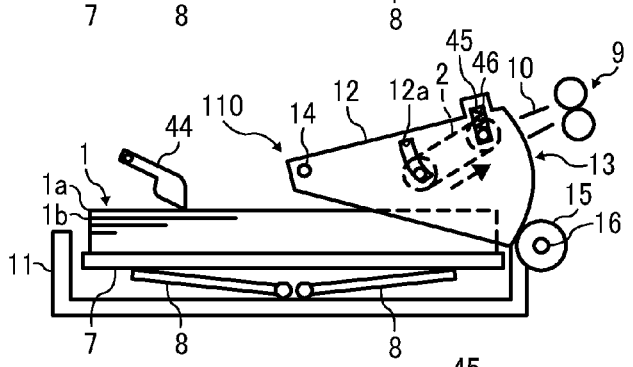

After the attraction separation unit 110 is stopped at the feed position, the drive motor 24 is driven to rotate the attraction belt 2, as illustrated in FIG. 8B. Then, an alternating voltage is supplied to the circularly moving attraction belt 2 by the charging power supply 4 via the electrode member 3. According to this action, charge patterns alternating with a pitch according to the frequency of the charging power supply 4 generating the AC voltage and the rotation speed of the attraction belt 2 are formed on the surface of the attraction belt 2. Preferably, the pitch is set to approximately 5 mm to approximately 15 mm. As well as the AC voltage, a direct-current (hereinafter referred to as DC) voltage alternated between high and low potentials may be provided by the charging power supply 4. The waveform of the voltage may be, for example, a rectangular or sine wave. In the present embodiment, the surface of the attraction belt 2 is applied with a rectangular-wave voltage having an amplitude of approximately 4 kV (kilovolts).

Figure 8C:
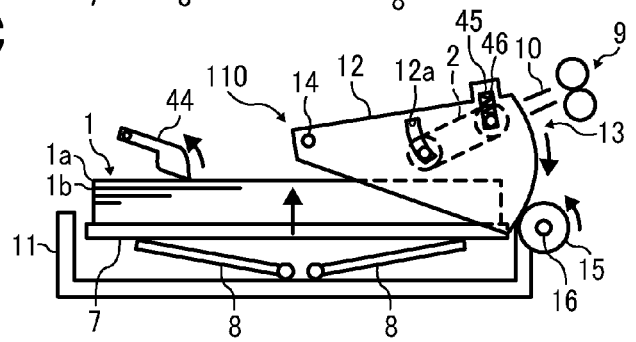

After the charging of the attraction belt 2 is completed, the rotation of the attraction belt 2 is stopped, and the bottom plate 7 standing by at the lowered position starts being lifted, as illustrated in FIG. 8C. Substantially at the same time, the swing motor 30 is rotated in the reverse direction to rotate the pinion gears 15 in the counterclockwise direction in the drawing. According to this action, the attraction separation unit 110 is swung around the support shaft 14 as a pivot in the clockwise direction in the drawing, i.e., a direction approaching the sheet bundle 1. As the bottom plate 7 is lifted and the attraction separation unit 110 is lowered, the uppermost sheet 1*a* of the sheet bundle 1 comes into contact with the upstream tension roller 6 via the attraction belt 2. If the bottom plate 7 is further lifted and the attraction separation unit 110 is further lowered, the upstream tension roller 6 is pushed upward by the sheet bundle 1. According to this action, the shaft 6*a* of the upstream tension roller 6 in contact with the lower ends 41 of the upstream slots 12*a* is moved upward along the upstream slots 12*a*. Further, the feeler 44 is rotated in the counterclockwise direction in the drawing in accordance with the lifting of the bottom plate 7. Then, upon arrival of the uppermost sheet 1*a* of the sheet bundle 1 to a predetermined position, the feeler 44 blocks the light from the light emitting portion 43*b* of the transmissive optical sensor 43. According to this action, the sheet detection device 40 detects the arrival of the uppermost sheet 1*a* of the sheet bundle 1 to the predetermined position, and the lifting of the bottom plate 7 is stopped.

Figure 8D:
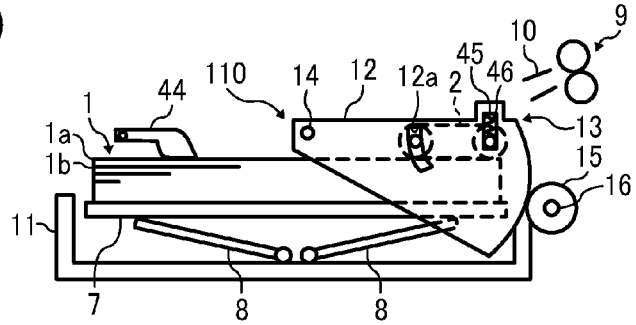

If the attraction separation unit 110 is further swung in the clockwise direction in the drawing, i.e., the direction approaching the sheet bundle 1, the downstream tension roller 5 comes into contact with the uppermost sheet 1*a* of the sheet bundle 1 via the attraction belt 2. If the attraction separation unit 11 in this state is further swung in the clockwise direction in the drawing, i.e., the direction approaching the sheet bundle 1, the downstream tension roller 5 is pushed upward by the sheet bundle 1 against the biasing force of the springs 46, as illustrated in FIG. 8D. According to this action, the shaft 5*a* of the downstream tension roller 5 in contact with the lower ends of the downstream slots 45 is moved upward along the downstream slots 45. Then, the rotation of the swing motor 30 is stopped, and the swing of the attraction separation unit 110 is stopped. If the swing motor 30 is a stepper motor, the swing motor 30 is controlled on the basis of the angle of rotation corresponding to the number of pulses, and thereby stopping the attraction separation unit 110 accurately at the attraction position. If the swing motor 30 is a DC motor, the swing motor 30 is controlled on the basis of the drive time, and thereby stopping the attraction separation unit 110 accurately at the attraction position.

As illustrated in FIG. 8D, when the lowering of the attraction separation unit 110 according to the swing thereof is stopped, the shaft 6*a* of the upstream tension roller 6 and the shaft 5*a* of the downstream tension roller 5 are both separated from and no longer supported by the lower ends 41 of the upstream slots 12*a* and the lower ends of the downstream slots 45, respectively. According to this action, the downstream and upstream tension rollers 5 and 6 are carried on the sheet bundle 1, and the attraction belt 2 supported by the attraction separation unit 110 is now supported by the sheet bundle 1. Accordingly, an area of the attraction belt 2 facing the sheet bundle 1 is reliably brought into contact with the uppermost sheet 1*a* of the sheet bundle 1, even if the position of the uppermost sheet 1*a* of the sheet bundle 1 in the height direction, i.e., the vertical direction in the drawing is slightly shifted from the intended position or the sheet bundle 1 is inclined. With the attraction belt 2 in contact with the uppermost sheet 1*a*, the Maxwell stress acts on the uppermost sheet 1*a*, which is a dielectric, owing to a non-uniform electric field generated by the charge patterns formed on the surface of the attraction belt 2. According to this action, the uppermost sheet 1*a* of the sheet bundle 1 is attracted to the attraction belt 2.

The attraction separation unit 110 stands by for a predetermined time in the state illustrated in FIG. 8D to attract the uppermost sheet 1*a* to the attraction belt 2. Then, the swing motor 30 is driven to drive the pinion gears 15 to rotate in the clockwise direction in the drawing, and the attraction separation unit 110 is swung around the support shaft 14 as a pivot in the counterclockwise direction in the drawing. According to this action, the shaft 5 of the downstream tension roller 5 carried on the sheet bundle 1 comes into contact with the lower ends of the downstream slots 45, and the downstream tension roller 5 moves together with the brackets 12 in the direction separating from the sheet bundle 1, while being supported by the brackets 12. By contrast, the lower ends 41 of the upstream slots 12*a* are located closer to the sheet bundle 1 than the downstream slots 45 are. In this state, therefore, the upstream tension roller 6 remains on the upper surface of the sheet bundle 1 owing to the self-weight thereof, and moves toward the sheet bundle 1 relative to the brackets 12. According to this action, the attraction belt 2 makes a swinging motion around the center of rotation of the upstream tension roller 6, and the uppermost sheet 1*a* attracted to the attraction belt 2 is bent at a portion of the attraction belt 2 wound around the upstream tension roller 6 as a pivot. As a result, resilience acts on the uppermost sheet 1*a* attracted to the attraction belt 2. According to this action, only the uppermost sheet 1*a* is attracted to the attraction belt 2, and the second sheet 1*b* is separated from the uppermost sheet 1*a* owing to the resilience of the uppermost sheet 1*a*.

Figure 8E:
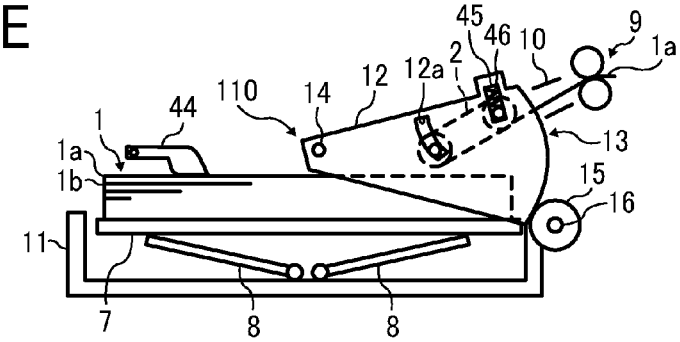

If the attraction separation unit 110 is further rotated around the support shaft 14 as a pivot in the counterclockwise direction in the drawing, the shaft 6*a* of the upstream tension roller 6 comes into contact with the lower ends 41 of the upstream slots 12*a*. If the attraction separation unit 110 is further rotated in the state in which the shaft 6*a* of the upstream tension roller 6 is thus in contact with the lower ends 41 of the upstream slots 12*a*, the upstream tension roller 6 moves together with the brackets 12 while being supported by the brackets 12, and separates from the upper surface of the sheet bundle 1. As illustrated in FIG. 8E, if the attraction separation unit 110 reaches the feed position for feeding a sheet, the driving of the swing motor 30 is stopped. Then, the drive motor 24 is driven to rotate the attraction belt 2 and feed the uppermost sheet 1*a* attracted to the attraction belt 2 toward the feed roller pair 9. When the leading end of the uppermost sheet 1*a* electrostatically attracted to the attraction belt 2 reaches a portion of the attraction belt 2 wound around the downstream tension roller 5, the uppermost sheet 1*a* is separated from the attraction belt 2 owing to the curvature of the downstream tension roller 5, and is moved toward the feed roller pair 9 along the guide members 10, as illustrated in FIG. 8E.

The feed roller pair 9 and the attraction belt 2 are set to the same linear velocity. If the feed roller pair 9 is intermittently driven to adjust the feed timing, the drive motor 24 is controlled to also intermittently drive the attraction belt 2. Further, the drive mechanism 130 may be provided with an electromagnetic clutch to control the driving of the attraction belt 2 by controlling the electromagnetic clutch.

The attraction belt 2 may be charged only by the length from the sheet separation position of the attraction belt 2 to the feed roller pair 9 and thereafter be discharged by the electrode member 3. This configuration allows the uppermost sheet 1*a* fed to the feed roller pair 9 to be thereafter fed solely by the feeding force of the feed roller pair 9 unaffected by the attraction belt 2. Further, the discharging of the attraction belt 2 minimizes electrostatic attraction of the second sheet 1*b* to the attraction belt 2, from which the second sheet 1*b* is separated.

As described above, in the present embodiment, the uppermost sheet 1*a* of the sheet bundle 1 is attracted to the attraction belt 2 supported by the upper surface of the sheet bundle 1. According to this action, the uppermost sheet 1*a* of the sheet bundle 1 is attracted to the attraction belt 2 while being reliably kept in contact with the area of the attraction belt 2 facing the sheet bundle 1, even if the position of the uppermost sheet 1*a* of the sheet bundle 1 in the height direction, i.e., the vertical direction in the drawings is slightly shifted from the intended position or the sheet bundle 1 is inclined. Consequently, the uppermost sheet 1*a* is reliably attracted to the attraction belt 2. Further, in the present embodiment, the downstream tension roller 5 is biased toward the sheet bundle 1 by the springs 46. Thus, the downstream tension roller 5 is brought into contact with the uppermost sheet 1*a* of the sheet bundle 1 with predetermined pressure. Accordingly, the uppermost sheet 1*a* is further reliably attracted to the attraction belt 2.

Further, normally, the area of the attraction belt 2 facing the sheet bundle 1 is reliably bought into contact with the uppermost sheet 1*a* of the sheet bundle 1 simply by the swing of the attraction separation unit 110 in the clockwise direction in the drawings, i.e., toward the sheet bundle 1 by a predetermined distance from the position at which the area of the attraction belt 2 facing the sheet bundle 1 is in contact with the uppermost sheet 1*a* of the sheet bundle 1. With this configuration, the area of the attraction belt 2 facing the sheet bundle 1 is brought into contact with the uppermost sheet 1*a* of the sheet bundle 1 with a relatively simple control mechanism, with no need to control the swing of the attraction separation unit 110 on the basis of the result of detection by a detection device provided to detect the contact of the area of the attraction belt 2 facing the sheet bundle 1 with the uppermost sheet 1*a* of the sheet bundle 1. Accordingly, the number of components of the sheet feeder 200 is reduced, and the cost of the sheet feeder 200 is reduced. Further, the control of the swing is simplified.

In the present embodiment, the brackets 12 are provided with the downstream slots 45 to hold the shaft 5*a* of the downstream tension roller 5 in the downstream slots 45. However, any other configuration may be employed which supports the shaft 5*a* of the downstream tension roller 5 separated from the upper surface of the sheet bundle 1, and which allows the downstream tension roller 5 to be movable in the direction perpendicular to the upper surface of the sheet bundle 1 relative to the brackets 12. Further, the configuration supporting the upstream tension roller 6 to be movable relative to the brackets 12 is not limited to the upstream slots 12*a*, and any other configuration may be employed which holds the upstream tension roller 6 to be swingable around the downstream tension roller 5 relative to the brackets 12, and which supports the upstream tension roller 6 such that the attraction belt 2 has a predetermined angle of tilt relative to the upper surface of the sheet bundle 1 when the attraction separation unit 110 is located at the feed position.

In the present embodiment, the uppermost sheet 1*a* is electrostatically attracted to the attraction belt 2 to be separated from the second sheet 1*b*. Therefore, multiple sheet feeding (i.e., feeding of a plurality of sheets in an overlapped manner) due to the influence of the coefficient of friction of sheets does not occur, unlike the configuration according to the separation method using frictional force.

In the present embodiment, gear meshing between the pinion gears 15 and the rack gear portions 13 causes the attraction separation unit 110 to swing. Therefore, the swing from the attraction position to the feed position and the swing from the feed position to the attraction position are both performed by the drive force of the swing motor 30. Thus, the attraction separation unit 110 is lowered to the attraction position faster than the speed of free fall thereof. After the feeding of the first sheet, therefore, the operation of attracting the next sheet is promptly started, and a reduction in the interval between the sheets is attained. Consequently, productivity is increased. Further, when the attraction separation unit 110 is swung to the attraction position, the attraction belt 2 is supported by the sheet bundle 1. Therefore, there is no need to accurately control the stop position of the attraction separation unit 110 at the attraction position. Further, the area of the attraction belt 2 facing the upper surface of the sheet bundle 1 is brought into contact with the uppermost sheet 1*a* of the sheet bundle 1 with no need to lift the bottom plate 7 or change the attraction position of the attraction separation unit 110 every time a sheet is fed.

In the present embodiment, the swing mechanism 120 is provided on the downstream side in the sheet feeding direction at a position relatively distant from the support shaft 14 serving as the swing pivot of the attraction separation unit 110. According to this action, the downstream side of the attraction separation unit 110 in the sheet feeding direction is supported by the pinion gears 15 and the rack gear portions 13 meshing with each other. As a result, the opposite ends of the attraction separation unit 110 are respectively supported by the support shaft 14 and the swing mechanism 120, and the vibration of the attraction separation unit 110 is minimized, as compared with a case where only one end of the attraction separation unit 110 is supported. This configuration minimizes the separation from the attraction belt 2 of the uppermost sheet 1*a* attracted thereto due to the vibration of the attraction separation unit 110. Further, at the downstream end portion of the attraction separation unit 110 in the sheet feeding direction, which is most distant from the support shaft 14 serving as the swing pivot of the attraction separation unit 110, the drive force is transmitted to the attraction separation unit 110 to swing the attraction separation unit 110. The portion for transmitting the drive force is thus set to a position relatively distant from the support shaft 14. Therefore, the distance from the swing pivot to the meshing portion serving as the pivot of the lever is longer than the distance from the centroid of the attraction separation unit 11 serving as the point of load in the principle of the lever to the swing pivot. With this configuration, the attraction separation unit 110 is swung with a relatively small load, as compared with a case where the drive force is transmitted on the side of the support shaft 14, i.e., the upstream side of the attraction separation unit 110 in the sheet feeding direction. Accordingly, an increase in size of the swing motor 30 is prevented, and thus an increase in size of the sheet feeder 200 is minimized. Further, abrasion of the meshing portions between the pinion gears 15 and the rack gear portions 13 is minimized.

Provided with the rack gear portions 13 and the pinion gears 15, the opposite ends of the attraction separation unit 110 in the belt width direction are supported by the rack gear portions 13 and the pinion gears 15 meshing with each other. According to this action, twisting of the attraction separation unit 110 is minimized.

The swing mechanism 120 is not limited to the above-described configuration, and may swing the attraction separation unit 110 by rotating the support shaft 14, which is fixed with rack gears and the brackets 12. Further, the swing mechanism 120 may be formed by a wire engaged with the downstream end portions of the brackets 12 and a winding device for winding the wire.

Figure 9:
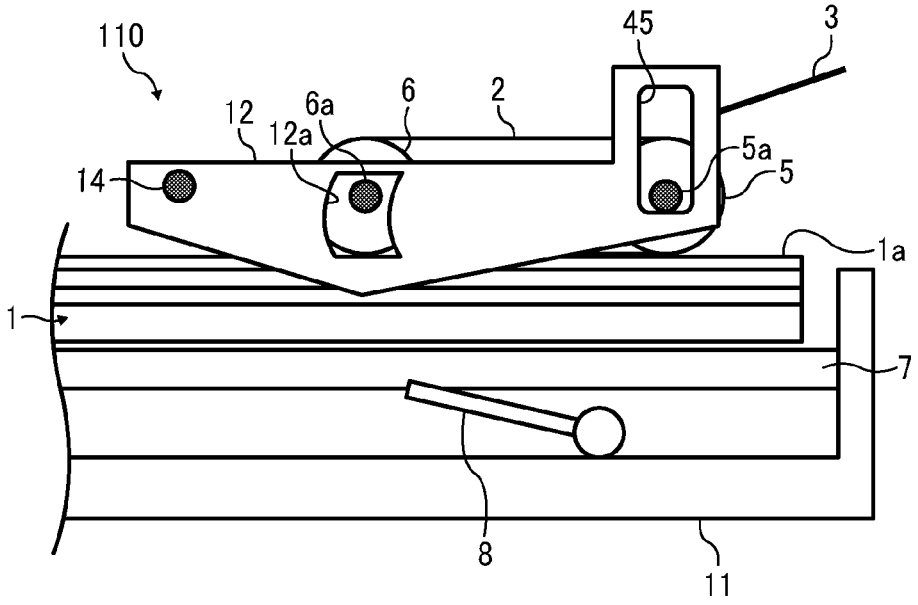
FIG. 9 is a diagram illustrating an embodiment of the attraction separation unit not including springs for biasing a downstream roller toward a sheet bundle.

In the present embodiment, the downstream tension roller 5 is biased toward the sheet bundle 1 by the springs 46. As illustrated in FIG. 9, however, the springs 46 may be omitted. As illustrated in FIG. 9, the configuration not including the springs 46 also allows the attraction belt 2 to be supported by the sheet bundle 1, when the attraction separation unit 110 is located at the attraction position. Thus, the area of the attraction belt 2 facing the sheet bundle 1 is reliably brought into contact with the uppermost sheet 1*a* of the sheet bundle 1.

Figure 10:
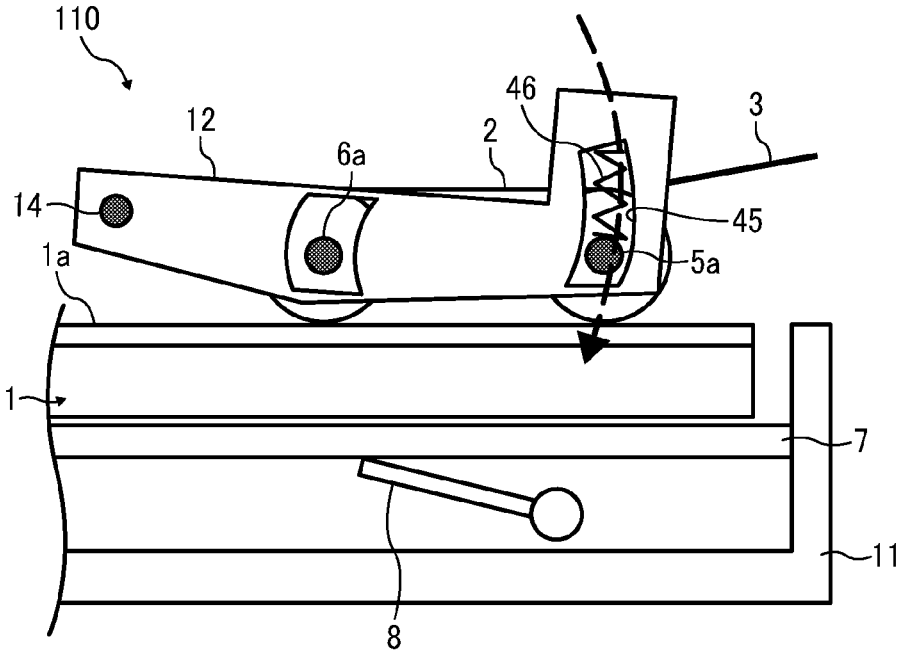
FIG. 10 is a diagram illustrating an embodiment of the attraction separation unit including downstream slots formed into an arc.

Further, as illustrated in FIG. 10, the downstream slots 45 may be formed into an arc centered on the support shaft 14 serving as the swing pivot of the attraction separation unit 110. With the downstream slots 45 thus formed into an arc, when the downstream tension roller 5 in contact with the sheet bundle 1 relatively moves in the direction separating from the sheet bundle 1 relative to the brackets 12, the shaft 5*a* of the downstream tension roller 5 smoothly moves within the downstream slots 45 without getting jammed. Further, even if the brackets 12 are swung in the clockwise direction in the drawing in the state in which the downstream tension roller 5 is in contact with the uppermost sheet 1*a* of the sheet bundle 1, respective surfaces of the downstream slots 45 in the short direction thereof are prevented from pushing the shaft 5*a* of the downstream tension roller 5 and changing the position of the downstream tension roller 5 in the sheet feeding direction. Accordingly, the relative positions of the shaft 5*a* of the downstream tension roller 5 and the support shaft 14 are kept constant, and the driven timing belt 28 is prevented from either excessive slackening or tightening.

Figure 11:
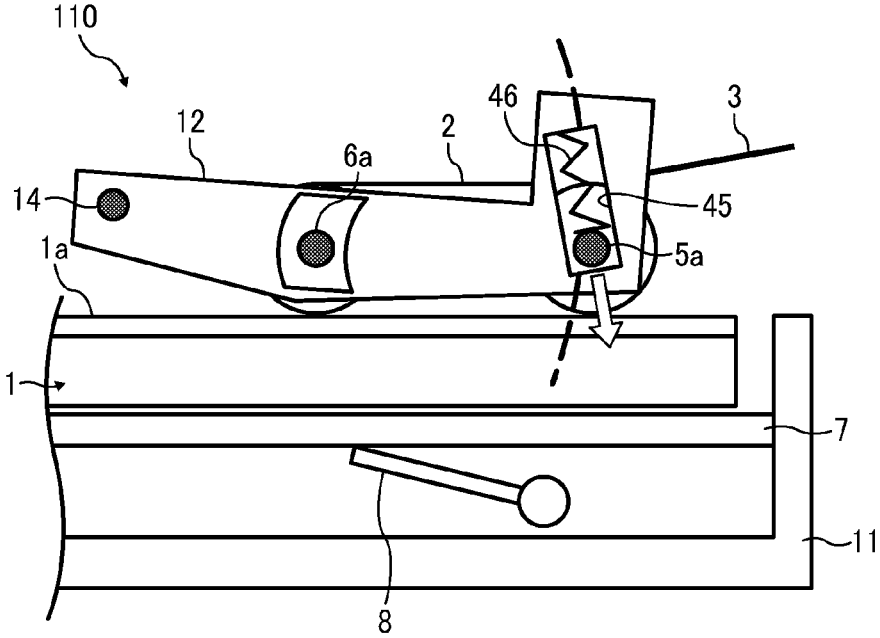
FIG. 11 is a diagram illustrating an embodiment of the attraction separation unit including inclined downstream slots.

Further, as illustrated in FIG. 11, the downstream slots 45 may be inclined such that the upper ends thereof are located upstream of the lower ends thereof in the sheet feeding direction. With this configuration, the point of contact between the shaft 5*a* of the downstream tension roller 5 and each of the lower ends of the downstream slots 45 is located downstream of the center of the downstream tension roller 5. That is, the shaft 5*a* of the downstream tension roller 5 is biased toward the lower ends of the downstream slots 45. When the attraction separation unit 110 swings from the feed position to the attraction position, therefore, the downstream tension roller 5 is biased downstream in the sheet feeding direction by the springs 46. As the attraction separation unit 110 swings, centrifugal force acts on the downstream tension roller 5 to move the downstream tension roller 5 downstream in the sheet feeding direction. With the action of the springs 46, however, the downstream tension roller 5 is already in contact with the downstream side of the lower ends of the downstream slots 45, which is downstream of the center of the downstream tension roller 5 in the sheet feeding direction. Therefore, the downstream tension roller 5 does not move. Consequently, even when the downstream tension roller 5 comes into contact with the sheet bundle 1 and thereby is released from the support by the brackets 12 and the centrifugal force acting thereon, the downstream tension roller 5 does not move upstream in the sheet feeding direction. Accordingly, vibration occurring in the downstream tension roller 5 is minimized.

Figure 12:
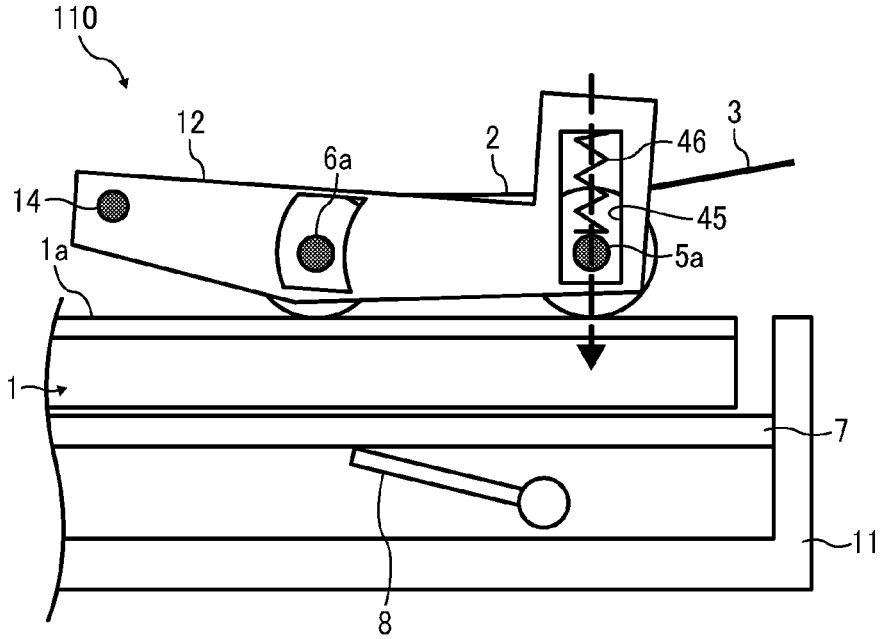
FIG. 12 is a diagram illustrating an embodiment in which downstream slots extend in a direction perpendicular to the sheet surface of the sheet bundle when the attraction separation unit is located at an attraction position.

Further, as illustrated in FIG. 12, the downstream slots 45 may be formed to extend in the direction perpendicular to the sheet bundle 1 when the attraction separation unit 110 is stopped at the attraction position. With this configuration, the downstream tension roller 5 is biased straight in the direction perpendicular to the upper surface of the sheet bundle 1 by the springs 46. According to this action, the attraction belt 2 is biased toward the sheet bundle 1 by the springs 46, and the uppermost sheet 1*a* is attracted to the attraction belt 2.

As described above, the sheet feeder 200 of the present embodiment includes the attraction separation unit 110 including the attraction belt 2 which is stretched between the upstream tension roller 6 and the downstream tension roller 5 and disposed to face the upper surface of the stacked sheet bundle 1 to attract the uppermost sheet 1*a* of the sheet bundle 1. The attraction separation unit 110 is rotatably supported by the support shaft 14 as a support member at a position upstream of the attraction belt 2 in the sheet feeding direction. The sheet feeder 200 further includes the swing mechanism 120 serving as the swing device which swings the attraction separation unit 110 around the support shaft 14 as a pivot to move the attraction belt 2 back and forth between the attraction position for attracting the uppermost sheet 1*a* of the sheet bundle 1 to the attraction belt 2 and the feed position for feeding the uppermost sheet 1*a*, which is more distant from the sheet bundle 1 than the attraction position is. The attraction separation unit 110 supports the downstream and upstream tension rollers 5 and 6 to be released from the support upon contact of the downstream and upstream tension rollers 5 and 6 with the uppermost sheet 1*a* of the sheet bundle 1 via the attraction belt 2. Specifically, the attraction separation unit 110 supports both of the downstream and upstream tension rollers 5 and 6 to be movable in the direction perpendicular to the upper surface of the sheet bundle 1 in a predetermined range. When the uppermost sheet 1*a* of the sheet bundle 1 is attracted to the attraction belt 2, therefore, the attraction belt 2 is carried on the uppermost sheet 1*a* of the sheet bundle 1 and supported by the sheet bundle 1, as described above. Even if the position of the sheet bundle 1 in the height direction is shifted from a predetermined position or the sheet bundle 1 is inclined, therefore, the area of the attraction belt 2 facing the sheet bundle 1 is reliably brought into contact with the uppermost sheet 1*a* of the sheet bundle 1. Accordingly, the uppermost sheet 1*a* is favorably attracted to the attraction belt 2.

The swing mechanism 120 swings the attraction separation unit 110 toward the sheet bundle 1 until both of the downstream and upstream tension rollers 5 and 6 relatively move in the perpendicular direction relative to the attraction separation unit 110. With this configuration, the attraction belt 2 supported by the attraction separation unit 110 is carried on the upper surface of the sheet bundle 1 and supported by the sheet bundle 1.

The attraction separation unit 110 is configured to, when moved in the direction separating from the sheet bundle 1, allow the downstream tension roller 5 to separate from the sheet bundle 1 before the upstream tension roller 6 separates from the sheet bundle 1. With this configuration, the attraction belt 2 being separated from the sheet bundle 1 makes a swinging motion around the center of rotation of the upstream tension roller 6, and the uppermost sheet 1*a* attracted to the attraction belt 2 is bent at a portion of the attraction belt 2 wound around the upstream tension roller 6. As a result, resilience acts on the uppermost sheet 1*a* attracted to the attraction belt 2. According to this action, only the uppermost sheet 1*a* is attracted to the attraction belt 2, and the second sheet 1*b* is separated from the uppermost sheet 1*a* owing to the resilience of the uppermost sheet 1*a*.

The swing mechanism 120 includes the gear mechanism, and thus is capable of swinging the attraction separation unit 110 from the feed position to the attraction position with the drive force of the swing motor 30. Therefore, the attraction separation unit 110 is swung from the feed position to the attraction position faster than in a case where the attraction separation unit 110 is swung from the feed position to the attraction position by the self-weight thereof. With this configuration, a reduction in the interval between the sheets is attained, as compared with a case where the attraction separation unit 110 is swung from the feed position to the attraction position by the self-weight thereof. Accordingly, productivity is increased.

The gear mechanism includes the rack gear portions 13 each serving as a first gear portion provided to the downstream end portion of the attraction separation unit 110 in the sheet feeding direction and the pinion gears 15 each serving as a second gear portion meshing with the corresponding rack gear portion 13. With this configuration, the downstream end portion of the attraction separation unit 110 in the sheet feeding direction is supported by the rack gear portions 13 and the pinion gears 15 meshing with each other. Consequently, the opposite ends of the attraction separation unit 110 are respectively supported by the support shaft 14 and the swing mechanism 120, and the vibration of the attraction separation unit 110 is minimized.

The downstream tension roller 5 may be supported to be movable relative to the attraction separation unit 110 along a substantially circular arc locus centered on the swing pivot of the attraction separation unit 110. This configuration allows the downstream tension roller 5 to come into contact with the sheet bundle 1 and relatively move around the support shaft 14 relative to the attraction separation unit 110. Thus, the position of the downstream tension roller 5 is unchanged. According to this action, the driven timing belt 28 wound around the first driven pulley 26*a* fixed to the support shaft 14 and the second driven pulley 25 fixed to the shaft 5*a* of the downstream tension roller 5 is prevented from being excessively slacked or stretched. Accordingly, the drop of the driven timing belt 28 from the first driven pulley 26*a* and the second driven pulley 25 and a reduction in life of the driven timing belt 28 are minimized.

The sheet feeder 200 may further include the springs 46 serving as a biasing device which biases the downstream tension roller 5 toward the sheet bundle 1. This configuration increases the contact pressure applied to the uppermost sheet 1*a* of the sheet bundle 1 by the attraction belt 2, as compared with a case where the attraction belt 2 is brought into contact with the uppermost sheet 1*a* by the self-weight thereof. With this configuration, the uppermost sheet 1*a* is favorably attracted to the attraction belt 2.

The sheet feeder 200 may be configured such that, when the attraction belt 2 is located at the attraction position, the direction of biasing by the springs 46 against the downstream tension roller 5 is perpendicular to the upper surface of the sheet bundle 1. This configuration highly effectively increases the contact pressure applied to the uppermost sheet 1*a* of the sheet bundle 1 by the attraction belt 2. With this configuration, the uppermost sheet 1*a* is favorably attracted to the attraction belt 2.

The springs 46 may bias the downstream tension roller 5 toward the sheet bundle 1 and downstream in the sheet feeding direction. This configuration brings the downstream tension roller 5 into contact with the respective downstream end surfaces of the downstream slots 45 with the biasing force of the springs 46. With the centrifugal force generated in the swing of attraction separation unit 110, therefore, the downstream tension roller 5 is prevented from moving upward in the sheet feeding direction. Accordingly, vibration of the downstream tension roller 5 occurring in the sheet feeding direction when the downstream tension roller 5 comes into contact with the uppermost sheet 1*a* of the sheet bundle 1 is minimized.

The image forming apparatus according to the present embodiment uses the above-described sheet feeder 200. Therefore, a sheet feeding failure is minimized. Further, the image forming apparatus according to the present embodiment does not require a contact state detection device, unlike the configuration of the foregoing background image forming apparatus. Accordingly, a reduction in cost of the image forming apparatus is attained.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A sheet feeder, comprising:

an attraction separation unit including an attraction belt stretched between rollers and disposed to face the upper surface of a stacked sheet bundle to attract an uppermost sheet of the sheet bundle, rotatably supported by a support member at a position upstream of the attraction belt in a sheet feeding direction wherein a downstream one of the rollers is movable relative to the support member;

a swing device to swing the attraction separation unit around the support member as a pivot to move the attraction belt back and forth between an attraction position for attracting the uppermost sheet of the sheet bundle to the attraction belt and a feed position for feeding the uppermost sheet attracted to the attraction belt that is more distant from the sheet bundle than is the attraction position, and configured to swing the attraction belt to the feed position to be rotated to feed the uppermost sheet after the uppermost sheet has been attracted to the attraction belt at the attraction position; and a biasing device to bias the downstream one of the rollers in the sheet feeding direction toward the sheet bundle.

2. The sheet feeder according to claim 1, wherein the rollers are movable in a direction perpendicular to the upper surface of the sheet bundle.

3. The sheet feeder according to claim 2, wherein the swing device swings the attraction separation unit toward the sheet bundle until both of the rollers move in a direction perpendicular to the attraction separation unit.

4. The sheet feeder according to claim 1, wherein the attraction separation unit is configured to, when moved in a direction separating from the sheet bundle, allow the downstream one of the rollers in the sheet feeding direction to separate from the sheet bundle before the upstream one of the rollers in the sheet feeding direction separates from the sheet bundle.

5. The sheet feeder according to claim 1, wherein the swing device includes a gear mechanism.

6. The sheet feeder according to claim 5, wherein the gear mechanism includes a first gear portion provided to a downstream end portion of the attraction separation unit in the sheet feeding direction and a second gear portion meshing with the first gear portion.

7. The sheet feeder according to claim 1, wherein the downstream one of the rollers in the sheet feeding direction is movable relative to the attraction separation unit along a substantially circular arc locus centered on the pivot of swing of the attraction separation unit.

8. The sheet feeder according to claim 1, wherein, when the attraction belt is located at the attraction position the biasing device biases the downstream one of the rollers in the sheet feeding direction in a direction perpendicular to the upper surface of the sheet bundle.

9. The sheet feeder according to claim 1, wherein the biasing device biases the downstream one of the rollers in the sheet feeding direction toward the sheet bundle and downstream in the sheet feeding direction.

10. An image forming apparatus, comprising:

an image forming device to form an image on a sheet; and a sheet feeder according to claim 1, configured to separate an uppermost sheet from a stacked sheet bundle and feed the uppermost sheet to the image forming device.

11. The sheet feeder according to claim 1, further comprising a bracket, wherein the rollers are held by the bracket to be movable in a direction perpendicular to the uppermost sheet.

12. The sheet feeder according to claim 11, wherein the bracket includes an upstream slot and a downstream slot, wherein a shaft of an upstream one of the rollers in the sheet feeding direction passes through the upstream slot, and a shaft of the downstream one of the rollers in the sheet feeding direction passes through the downstream slot.

13. The sheet feeder according to claim 12, wherein when the attraction separation unit is located at the feed position, the shaft of the upstream one of the rollers is in contact with a respective lower end of the upstream slot, and the shaft of the downstream one of the rollers is in contact with a respective lower end of the downstream slot.

14. The sheet feeder according to claim 1, wherein a tension of the attraction belt is unchanged during the swing of the attraction separation unit between the attraction position and the feed position.

15. The sheet feeder according to claim 6, wherein the first gear portion of the gear mechanism includes an arc that is centered on the support member and swings around the support member.

16. The sheet feeder according to claim 6, wherein during the swing of the attraction separation unit, meshing between the first gear portion and the second gear portion is maintained.

17. The sheet feeder according to claim 1, further comprising a swing motor, wherein the swing from the attraction position to the feed position and the swing from the feed position to the attraction position are both performed by a driving force of the swing motor.

18. The sheet feeder according to claim 17, wherein the attraction separation unit is swung from the feed position to the attraction position faster than in a case where the attraction separation unit is swung from the feed position to the attraction position.

19. The sheet feeder according to claim 1, wherein the attraction separation unit is configured to, when moved in a direction separating from the sheet bundle, allow the downstream one of the rollers to separate from the sheet bundle before an upstream one of the rollers separates from the sheet bundle.

* * * * *